US006824256B2

(12) United States Patent
Thielman et al.

(10) Patent No.: US 6,824,256 B2
(45) Date of Patent: Nov. 30, 2004

(54) LOW AIR TRANSMISSION RATE INK VALVE

(75) Inventors: Jeffrey Thielman, Corvallis, OR (US); Rhonda L. Wilson, Monmouth, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 33 days.

(21) Appl. No.: 10/350,434

(22) Filed: Jan. 24, 2003

(65) Prior Publication Data

US 2004/0145634 A1 Jul. 29, 2004

(51) Int. Cl.[7] ..... B41J 2/175
(52) U.S. Cl. ..... 347/85; 347/87
(58) Field of Search ..... 347/85, 86, 87; 137/854, 852

(56) References Cited

U.S. PATENT DOCUMENTS 4,558,326 A * 12/1985 Kimura et al. ..... 347/30
4,604,633 A * 8/1986 Kimura et al. ..... 347/7
4,641,154 A 2/1987 Mikalsen
4,677,447 A * 6/1987 Nielsen ..... 347/87
5,289,212 A 2/1994 Carlotta
5,500,663 A 3/1996 Ujita
5,719,609 A * 2/1998 Hauck et al. ..... 347/85
5,736,992 A * 4/1998 Pawlowski, Jr. ..... 347/7
5,808,643 A 9/1998 Tracy
5,812,168 A * 9/1998 Pawlowsk et al. ..... 347/92
5,923,353 A * 7/1999 Boyd et al. ..... 347/85
6,196,671 B1 3/2001 Breemes, Sr.
6,213,596 B1 4/2001 Nowell
6,267,473 B1 7/2001 Smith

* cited by examiner

*Primary Examiner*—Anh T. N. Vo

(57) ABSTRACT

Valves, ink delivery systems, and a method are provided for moving ink from an ink supply source to a printhead. The printhead ejects ink onto a print media to satisfy a print job. An inlet receives ink from the ink supply source within a central cavity of a valve. The ink flows through the central cavity to an outlet that is interfaced to the printhead. Moreover, the central cavity is segmented into first and second regions. In one embodiment, an Elastomer material segments the central cavity. The first region includes a seal adapted to close the inlet when the valve is in a closed position. The second region includes an actuation means for moving the seal to open and closed positions. Further, in one embodiment, the second region is humidified.

28 Claims, 3 Drawing Sheets

LOW AIR TRANSMISSION RATE INK VALVE

FIELD OF THE INVENTION

The present invention is related to ink valves, ink delivery systems, and a method that limit the air transmission rates into an ink supply and/or ink tube of an ink delivery system.

BACKGROUND OF THE INVENTION

During the process associated with printing in an ink delivery system, an ink supply source delivers ink to a printhead for ejection onto a print media. The ink supply exerts a large negative pressure on a printhead regulator. Moreover, as ink is moved from the ink supply source to the printhead air can permeate and be absorbed into intermediate components of the ink delivery system. Air absorption causes air to excessively accumulate in the printhead, such that when too much air has accumulated little to no ink will be ejected from the printhead. Further, a pressure regulator within the printhead can malfunction from too much air absorption causing the printhead to leak ink, which can degrade print quality.

Accordingly, various techniques have attempted to create better seals for the components and/or connections used within ink delivery systems in order to minimize the amount of air absorption or air transmission within the systems. One technique uses a check valve that is interposed between the ink supply source and the printhead. However, a check valve does not permit a good quality seal that minimizes back flow from a printhead. Another technique uses a pinch valve that is interposed between the ink supply source and the printhead. Yet, with a pinch valve it is difficult to pinch materials in the ink delivery system that are good air barriers. Typically, pinch valve techniques use materials for components of the ink delivery system that have low compression properties with high air transmission properties.

Therefore, there is a need for improved ink valves, ink delivery systems, and techniques with low air transmission rates. Moreover, the materials for the various components of the ink valves and the ink delivery systems should be durable materials that to not degrade or do not introduce chemicals into the ink supply after extended exposure to ink.

SUMMARY OF THE INVENTION

Briefly and in general terms, an ink valve, in various embodiments of the present invention, includes an inlet for receiving a portion of a supply of ink from an ink supply source. Furthermore, the valve includes an outlet for ejecting ink to a printhead. Ink is gathered into a central cavity or chamber from the inlet. The central cavity is segmented into two regions by an Elastomer material. The first region includes a seal that is located on the Elastomer material and adapted to close and/or plug the inlet in order to stop and/or permit the flow of ink into the central cavity. The second region includes a mechanism for applying and releasing a force that moves the seal away from or toward the inlet.

DETAILED DESCRIPTION OF THE INVENTION

In the following description and the drawings illustrate specific embodiments of the invention sufficiently to enable those skilled in the art to practice it. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the full ambit of the claims and all available equivalents. The following description is, therefore, not to be taken in a limited sense, and the scope of the present invention is defined by the appended claims.

The functions described herein are implemented in software in one embodiment, where the software comprises computer executable instructions stored on computer readable media such as memory or other type of storage devices. The term "computer readable media" is also used to represent carrier waves on which the software is transmitted. Further, such functions correspond to modules, which are software, hardware, firmware of any combination thereof. Multiple functions are performed in one or more modules as desired, and the embodiments described are merely examples.

Figure 1A:
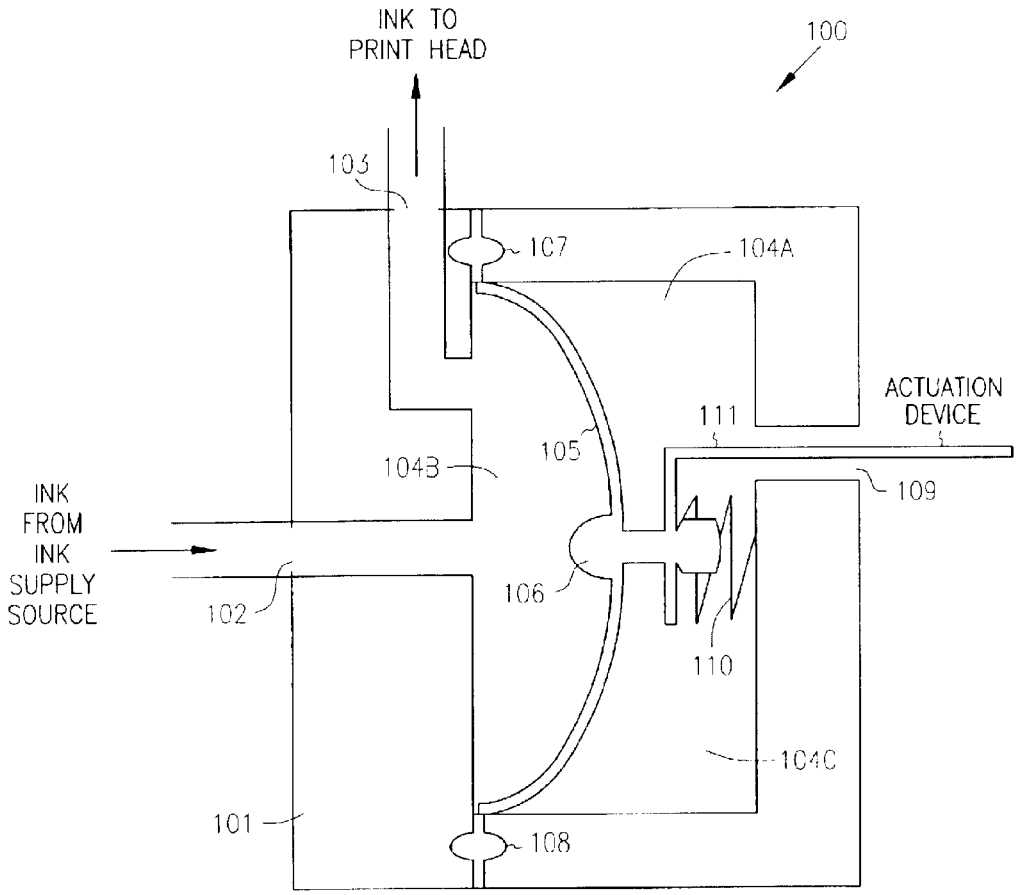
FIG. 1A is a diagram of an ink valve in an open position, according to various embodiments of the present invention.

FIG. 1A illustrates a diagram of an ink valve 100 in an open position, according to various embodiments of the present invention. The ink valve 100 is made of a material 101 that encases various other components of the ink valve 100. In one embodiment, the material 101 is molded from a low air permeable material, such as Polyethylene Terephtalate (PET), Liquid Crystalline Polymer (LCP), Ethylene-Vinyl Alcohol Copolymer (EVOH), Polyetherimide (PEI), nylons which are low air permeable, and the like.

The ink valve 100 also includes an inlet or ink entry chamber 102, an outlet or exit chamber 103, a central cavity or holding chamber 104A, an Elastomer material 105 having a seal 106, two additional seals 107 and 108, an opening 109 for an actuation device source interface, a means for applying force 110, and a mechanism for applying or releasing the force 111.

The Elastomer material 105 is molded to form a strip which when pressurized may form the shape of a dome. In one embodiment, the Elastomer material 105 is a high barrier Elastomer, such as Ethylene Propylene Diene Monomer (EPDM), Fluorocarbon, Butyl, Butadiene, and others. The Elastomer material can also be a blending or a combination of materials, such as EPDM-Butyl, and others. The Elastomer material 105 also includes a seal 106. The seal 106 is a bump of excess Elastomer material 105 that is larger than a diameter of the inlet 102.

The Elastomer material 105 also includes two additional ribbed seals 107 and 108. The ribbed seals 107 and 108 are crushed against an outside of the central cavity 104A when ink fills into the central cavity 104A from the ink supply through the inlet 102. This ensures a zone of high compression with minimal air leakage into the central cavity 104A. The ribbed seals 107 and 108 can be fastened to the central cavity 104A with screws or any other fastening mechanism that maintains high compression on the Elastomer material 105.

The central cavity 104A also includes an opening 109 for receiving an interface or a portion of an opening and closing means 111 from an actuation source device. The interface or opening and closing means 111, in one embodiment, is associated with components of a lever, cam, and/or other similar mechanism. The interface or opening and closing means 111 can include a spring 110 that when compressed pulls the Elastomer material 105 back away from the inlet 102 resulting in a portion of the supply of ink flowing into the central cavity 104A from the ink supply source and out of the outlet 103 to a printhead.

The activation source device receives instructions to activate the interface 111 from a printer controller in communication with the ink delivery system. As a result a force is applied to the interface or opening and closing means 111 that compresses the spring 110 opening the inlet 102. In one embodiment, the interface or a portion of the opening and closing means 111 enters the opening 109 with minimal clearance and/or through a bushing and/or o-ring. This will further seal the ink valve 100 by minimizing the transfer of water vapor between the valve 100 and the outside environment.

The configuration and components of the ink valve 100 also permit any air that enters the central cavity 104 to more readily partially diffuse through the Elastomer material 105 and away from the ink. For example, the Elastomer material 105 separates the central cavity 104A into two regions 104B and 104C. The first region 104B is the chamber where ink flows within the central cavity 104A. The second region 104C is the chamber where the actuation interface or opening and closing means 111 and spring 110 are placed within the central cavity 104A.

As ink flows or moves within the first region 104B air molecules from the environment can collect over time and assemble together as air bubbles within the first region 104B. However, because ink includes large amounts of water molecules the humidity or the air within the first region 104B will be at a nearly 100% humidity. The second region 104C is primarily filled with air that is humidified, because of the narrow opening 109. As a result, the concentration of water molecules within the air of the second region 104C will be approximately equal to the concentration of water vapor in the first region 104B. Thus, there will be roughly equivalent concentration levels of Oxygen and/or Nitrogen for the air molecules of the second region 104C, as the concentration of Oxygen and/or Nitrogen for the air molecules in the first region 104B. Consequently, any accumulated air molecules within the first region 104B will seek to achieve equilibrium and diffuse into the second region 104C, thereby minimizing the growth of air bubbles that may tend to accumulate within the first region 104B. The high humidity within the second region 104C reduces the driving forces of air being diffused into the first region 104C through the Elastomer material 105 and seal 106.

As one of ordinary skill in the art now appreciates, the ink valve 100 is a low air transmission ink valve that optimally minimizes air retention within the central cavity 104A where ink flows. Moreover, the ink valve 100 is conducive to minimizing accumulated air within a first region 104B of a central cavity 104A where ink flows. This will result in less wear and tear on the printhead, require less maintenance of the printhead, and produce improved quality print jobs.

Figure 1B:
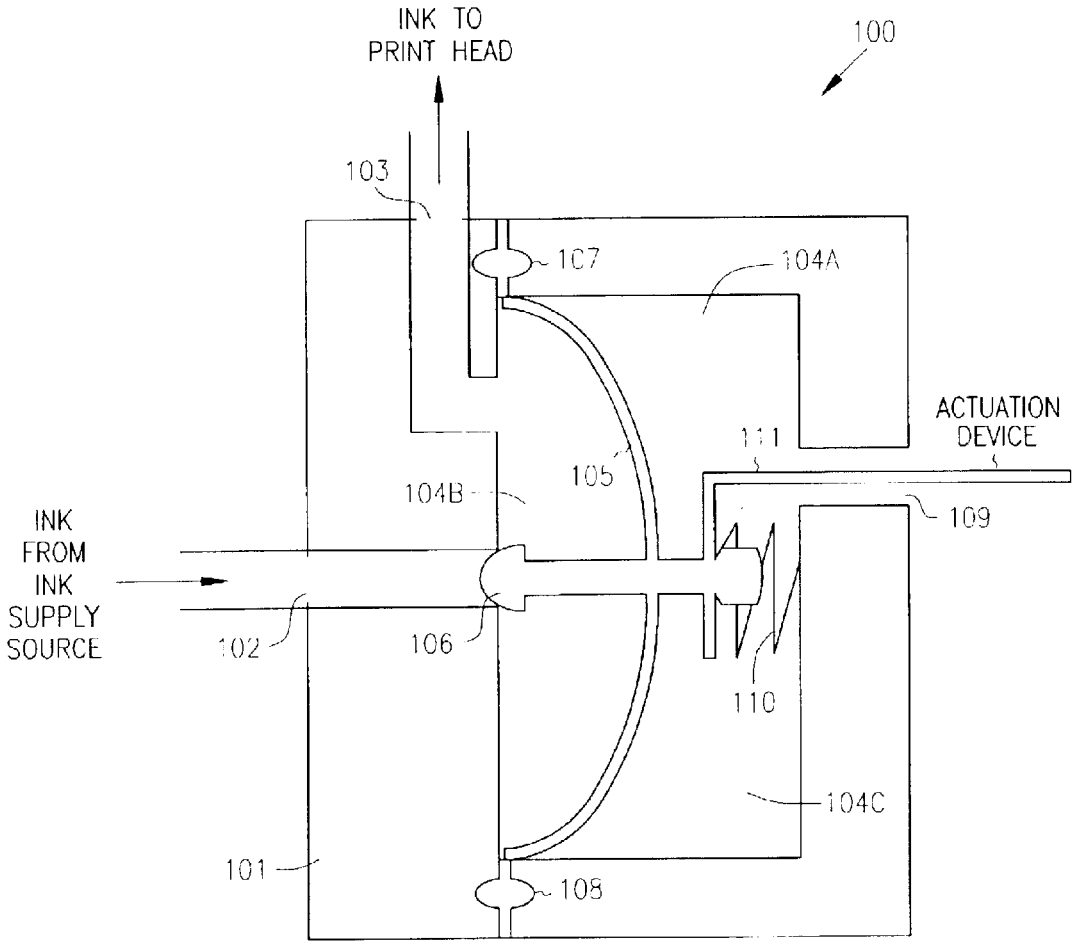
FIG. 1B is a diagram of the FIG. 1A ink valve in a closed position, according to one embodiment of the present invention.

FIG. 1B illustrates a diagram of the FIG. 1A ink valve 100 in a closed position, according to one embodiment of the present invention. Again, the ink valve 100 includes an encasing 101, an inlet 102, an outlet 103, a central cavity or chamber 104A, a separating strip of material 105, a seal, two additional seals 107 and 108, an opening 109 to permit an interface to an actuation source device, a force device or means 110, and an opening and closing means 111.

The ink supply source, the ink valve 100, the printhead, and the actuation source device comprise a portion of an ink delivery system. The ink delivery system can include one or more ink supply sources, ink valves 100, printheads, and actuation source devices. In some embodiments, the ink delivery system is an ink jet printer having one or more ink cartridges that represent the ink supply sources. In other embodiments, the ink delivery system includes a single ink supply source, a single ink valve, and a single actuation source device. A printer controller drives the actuation source device. The printer controller is firmware, software, or a combination of firmware and software. In response to instructions received, the printer controller instructs the actuation source device to apply a force to the opening and closing means 111 in order to move the separating material 105 away from the inlet by compressing the force means and/or mechanism 110.

The activation source device also stops asserting a force resulting in the force device or means 110 in applying a force to the opening and closing means 111 that causes the seal 106 to cover or close the inlet 102. In one embodiment, the force device or means 110 is applied by a spring that is compressed when the opening and closing means 111 receives a force from the actuation source device causing the spring to compress and moves the seal 106 away from the inlet 102 (depicted in FIG. 1A). When the actuation source device stops exerting a force on the opening and closing means 111, then the spring is free to expand to an uncoiled position that results in the Elastomer material 105 and the corresponding seal 106 being moved against the inlet 102 to plug the inlet 102 (depicted in FIG. 1B).

The central cavity or chamber 104A is segmented into two regions 104B and 104C by the Elastomer material 105. The first region 104B is on a side of the Elastomer material 105 that includes the seal 106, the inlet 102, and the outlet 103. The second region 104C is on a side of the Elastomer material 105 that includes the opening 109 to receive the opening and closing means 111 and the force device or means 110. The second region 104C is maintained at roughly an equal humidity level as the second region 104B. Thus, any accumulating air in the first region 104B will not tend to increase due to diffusion or air from the second region 104C. This further reduces air transmission into the first region 104B.

Accordingly, as one of ordinary skill in the art now appreciates, a low air transmission rate ink valve 100 is provided. Therefore, ink delivery systems using the ink valve 100 produce less wear and tear on printheads, require less maintenance of printheads, and can produce better quality output to print media.

Figure 2:
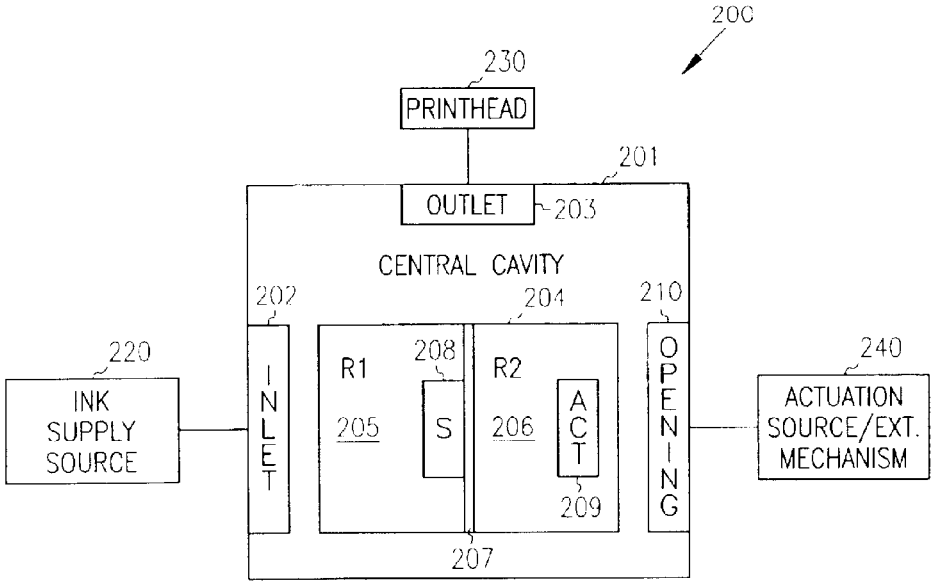
FIG. 2 is a diagram of an ink delivery system, according to various embodiments of the present invention.

FIG. 2 illustrates a diagram of an ink delivery system 200, according to various embodiments of the present invention. The ink delivery system 200 includes an encasing 201, an inlet 202, an outlet 203, a central cavity or chamber 204, a separating material 207 having a seal 208, an actuation means 209, and an opening 210 to an external mechanism or actuation source device 240.

The encasing 201 can be made of two molded plastic parts from a low air permeable material, such as PET, LCP, EVOH, low air transmission rate nylons, and others. The separating strip of material 207 includes the seal 208 located approximately in the center of the separating strip of material 207 directly opposing the inlet 202. In one embodiment each end of the separating strip of material includes additional ribbed seals (not depicted in FIG. 2) located on the outside of the central cavity 204. The ribbed seals provide a zone of high compression for the separating strip of material 207 where it is affixed to the encasing 201 thereby, minimizing air leakage into the central cavity 204 from the surrounding environment. The ribbed seals and the corresponding separating strip of material 207 can be fastened to encasing 201 and/or central cavity 204 using any fastening technique, such as screws.

The separating strip of material 207 is molded from an Elastomer material such as a high barrier Elastomer, EPDM, Fluorocarbon, Butyl, Butadiene, a blending Elastomer material (e.g., EPDM-Butyl) and the like. The separating strip of material 207 is molded with the ribbed seals and the seal 208. In one embodiment, the seal 208 is a bump of material that is used for the separating strip of material 207. The bump 208 is slightly larger in diameter than a diameter of the inlet 202. In one embodiment, the diameter of the bump 208 is approximately in the range of 2 to 4 millimeters. Of course as one of ordinary skill in the art appreciates, the diameter of the bump 208 is dependent upon the diameter of the inlet 202, thus the size of this bump 208 is configurable during design and manufacture of the components of the ink delivery system 200.

The separating strip of material 207 also segments the central cavity or chamber 204 into a first region 205 and a second region 206. The first region 205 includes the seal 208 and is opened to the inlet 202. Moreover, the first region 205 is open to the outlet 203 and permits a portion of a supply of ink to freely flow from the inlet 202 into the outlet 203 when the seal 208 is moved away from the inlet 202. The second region 206 includes an actuation means 209 and an opening 210 for receiving a force from an external mechanism or actuation source device 240. The actuation means 209 and the external mechanism 240 combine to exert forces against a second region side of the separating strip of material 207 in order to move the seal 208 against and away from the inlet 202.

When a force is delivered by the external mechanism 240 through the opening 210, then the actuation means 209 pulls the separating strip of material 207 and the attached seal 208 away from the inlet 202. This permits a portion of a supply of ink to flow from an ink supply source 220 into the first region 205 of the central cavity or chamber 204. The portion of the supply of ink then flows through the outlet 203 to a printhead 230 of the ink delivery system 200.

When the external mechanism 240 stops exerting the force through the opening 210, then the actuation means 209 applies a force against the separating strip of material 207 causing the separating strip of material 207 and its attached seal 208 to plug or cover the inlet 202. This seals the inlet 202 and prevents ink from flowing into the central cavity or chamber 204.

The external mechanism 240 applies and releases forces based on direction of a printer controller associated with the ink delivery system 200. The printer controller receives instruction to activate or deactivate the external mechanism based on commands received for processing a print job within the ink delivery system 200. The external mechanism 240 can be any device that is adapted to apply and release a force to components of the actuation means 209 that interface through the opening 210.

Moreover, in some embodiments, the components that interface through the opening 210 can include a diameter that is slightly smaller than the diameter of the opening 210. This provides a minimal clearance for the components and will promote an environment within the second region 206 that is humidified. The first region 205 will be humidified since ink flowing in the first region 205 includes large amounts of water molecules. Thus, partial pressures of Oxygen and Nitrogen in the first region 205 and the second region 206 will be maintained at a state of equilibrium. To further provide a high humidity for the second region 206 the components that interface through the opening 210 can include additional sealing components such as a bushing, an o-ring, and the like.

In one embodiment, the actuation means 209 is a cam or lever used to apply positive and negative forces against the separating strip of material 207 and its seal 208 in order to close and open the inlet 202. In one embodiment, the actuation means 209 includes a spring that is compressed when the actuation means 209 receives a force from the external mechanism 240 that draws the components that interface through the opening 210 toward the external mechanism 240. When the spring is compressed it draws or pulls the separating strip of material 207 toward the opening 210, which moves the seal 208 away from the inlet 202 and permits a portion of the supply of ink to flow from the ink supply source 220 into the first region of the central cavity or chamber 204 and out of the outlet 203 to the printhead 230. When the external mechanism stops exerting a force on the components of the actuation means 209, then the components move back to their initial state by releasing the spring from its coiled position. This causes the spring to expand and thus exerts a force on the separating strip of material 207 that causes the seal 208 to press against, plug, or cover the inlet 202. In this way, the inlet 202 does not receive ink into the first region 205 when the seal is pressed against the inlet 202.

Moreover, when the ink delivery system stops receiving power from a power source and/or when power is interrupted the external mechanism 240 will stop exerting any force that may be applied to the components of the actuation means 209 through the opening 210. As a result, the actuation means 209 goes to its initial state, which applies a force to the second region's side of the separating strip of material 207 in order to move the seal 208 against the inlet 202 preventing the flow of ink into the first region 205. Of course, when normal power exist within the ink delivery system 200, the force being applied and released by the external mechanism is controlled by a printer controller of the ink delivery system 200.

The ink delivery system 200 can be a standalone appliance device (e.g., photo printer, printer kiosk), a peripheral printing device that interfaces to a computing device, and/or a peripheral printing device that interfaces over a network to one or more computing devices.

One of ordinary skill in the art now appreciates upon reading and comprehending the above description how an ink delivery system 200 is implemented with a low air transmission valve. The low air transmission valve reduces air that is diffused into the ink supply during delivery of a portion of the ink supply to a printhead 203. Thus, less maintenance and wear and tear of the printhead 203 is achieved. Moreover, print quality is improved. Additionally, the ink delivery systems 200 are conducive to diffuse any accumulated air out of the chamber where ink flows.

Figure 3:
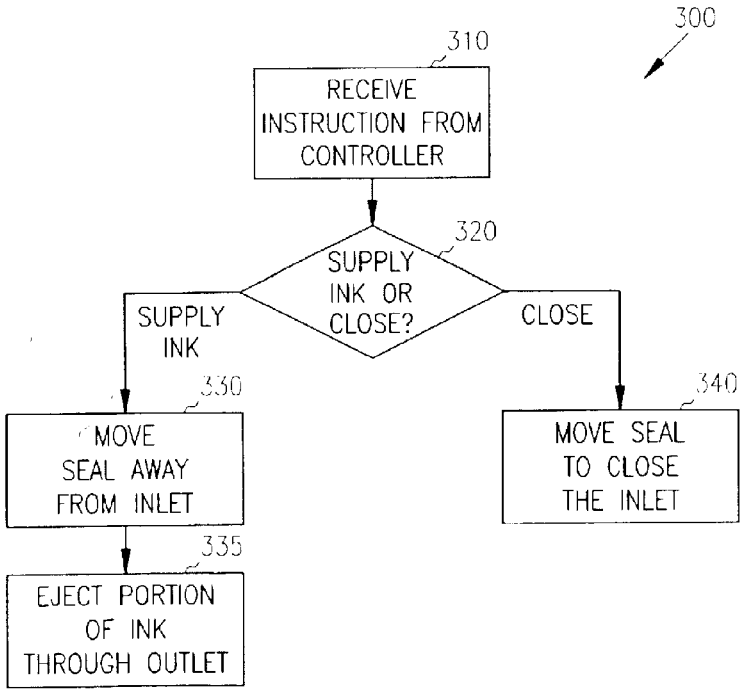
FIG. 3 is a flow chart representing a method for moving ink through an ink delivery system, according to various embodiments of the present invention.

FIG. 3 illustrates a flow chart representing one method 300 for moving ink through an ink delivery system, according to various embodiments of the present invention. The method 300 is implemented within an ink delivery system. Moreover, the method 300 is implemented, in one embodiment, as an ink valve that is interposed between an ink supply source and a printhead within the ink delivery system.

At 310, an instruction is indirectly received from a printer controller within the ink delivery system. For example, an external actuation source device receives a command from a printer controller to apply a force or release a force. Moreover, in some embodiments, the external actuation source device can also indirectly receive the instruction from the printer controller, such as when power is interrupted or terminated within the ink delivery system. In response to the instruction, the external actuation source device applies a positive force or removes a force (e.g., negative force).

When the instruction directs the external actuation source device to apply a positive force, then this is an indication that an ink valve is to open in order to permit ink to flow from an inlet connected to an ink supply source through the valve and out an outlet connected to a printhead. If the instruction indicates or a loss of power occurs, then this is an indication that the ink valve is to close in order to plug or seal the inlet and prevent the flow of ink to the outlet and the printhead.

Accordingly, at 320, depending upon the type of instruction received, the seal is appropriately opened or closed within the ink valve. If the instruction directs the seal to open, then at 330 the external actuation source device exerts a positive force on an interface component through an opening in the valve. The interface component is associated with an internal opening and closing means within the valve. By exerting the positive force, the interface component is partially drawn through the opening toward the external actuation source device. This causes other components within the opening and closing means to contract and apply a negative force against a separating strip of material within the valve.

The separating strip of material segments an internal cavity or chamber into two regions. The first region is open to the inlet and the outlet of the valve and is where ink flows within the valve when the valve is in an open position. The separating strip of material is molded from a high barrier Elastomer material, such as EPDM, Fluorocarbon, Butyl, Butadiene, a combination or blending of Elastomer material (e.g., EPDM-Butyl), and the like. The molded material includes two ribbed seals that are used to affix the separating strip of material within the central cavity. The ribbed seals are located on an outer side of the central cavity and provide an air barrier to the central cavity. The molded material also includes a seal that is a located within the first region of the central cavity directly opposed to the inlet into the central cavity. The seal within the first region is adapted to cover the inlet when pressed against the inlet in order to prevent the flow of ink into the first region.

The second region of the central cavity includes the opening and closing means and the opening through which the interface component communicates with the external actuation source device. Thus, when an instruction indicates that ink is to flow into the valve for delivery to the printhead, the external actuation source device applies a positive force to the interface component that causes the other components, which are partially attached to a second region side of the separating strip of material to contract. This forces the separating strip of material toward the opening and the seal away from the inlet. Ink will then flow into the first region and eject out of the outlet for delivery to the printhead, as depicted at 335.

When an instruction indicates or when power is interrupted, the seal within the valve will be forced to press against or cover the inlet preventing the flow of ink into the first region of the central cavity. This is achieved when the external actuation source device stops apply a positive force (e.g., negative force is applied) to the interface component. Accordingly, the other components of the opening and closing means move toward an initial state in which the separating strip of material receives a positive force from the opening and closing means to force the seal to press against and cover the inlet. Therefore, the seal is moved to close the inlet, as depicted at 340.

In one embodiment, the opening and closing means is a cam or lever including a spring. Thus, when the external actuation source device applies a positive force the cam or lever contracts thereby compressing the spring attached to the separating strip of material. This pulls the separating strip of material toward the opening and moves the seal away from the inlet. When the external actuation source device loses power, has power interrupted, or is otherwise directed by a printer controller to close the valve, then the positive force is released from the interface component of the cam or level, this releases the compressed spring and forces the seal to cover the inlet.

In one embodiment, the opening to the interface component is only slightly larger in diameter than the diameter of the interface component. In still more embodiments, the interface component is surrounded by a bushing and/or o-ring. By minimizing the space between the interface component and the opening this will further promote the build up of water vapor within the second region (e.g., the second region will be of high humidity). The first region will be of at an equivalent humidity level when ink is flowing through the first region, since ink includes a large concentration of water. Moreover, as previously discussed, any accumulated air within the first region will not tend to increase due to air diffusion from the second region.

Thus, the method 300 permits the implementation of a low air transmission technique for an ink delivery system, where air is optimally minimized within the components where ink flows from an ink supply source to a printhead. Moreover, any accumulated air will naturally tend to diffuse itself out of the area where ink flows. This puts less strain on the printhead and improves the quality of print output.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to one of ordinary skill in the art upon reviewing the above description. The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

What is claimed is:

1. An ink valve for an ink delivery system, comprising:

an entry cavity for receiving a supply of ink from an ink supply source;

an exit cavity for ejecting a portion of the supply of ink to a printhead of the ink delivery system; and a central cavity for moving the portion of the ink from the entry cavity to the exit cavity, and wherein the central cavity is divided into two regions including a first region for housing the portion of the ink when the valve is in an open position and a second region that includes an opening and closing means for opening and closing an opening of the entry cavity, and wherein at least a portion of the opening and closing means remains and resides within the second region and a remaining portion of the opening and closing means does not extend into the first region.

2. The ink valve of claim 1 wherein the first and second regions are separated by an Elastomer material.

3. The ink valve of claim 2 wherein the Elastomer material includes a bump that seals the entry cavity when the opening and closing means is in a closed position.

4. The ink valve of claim 3 wherein the opening and closing means includes a spring that when released forces the bump to seal the entry cavity and prevent the portion of the supply of ink from entering the first region.

5. The ink valve of claim 4 wherein the opening and closing means compresses the spring to move the bump away from the opening of the entry cavity into the central cavity allowing the portion of the supply of ink to enter the first region of the central cavity.

6. The ink valve of claim 1 wherein the opening and closing means is activated by a cam and/or lever.

7. The ink valve of claim 1 wherein the first and second regions are separated by a material made from at least one of Ethylene Propylene Diene Monomer (EPDM) material, Fluorocarbon material, Butyl material, a Butadiene material, and a combination EPDM-Butyl material.

8. The ink valve of claim 1, wherein the second region is humidified to a humidity level that is substantial equivalent to a first region humidity level.

9. An ink delivery system, comprising:

a supply of ink; and a valve having an inlet for receiving a portion of the supply of ink, an outlet for ejecting the portion of the supply of ink to a printhead, and a central cavity separated into a first region and a second region, wherein the regions are separated by an Elastomer material having a seal, and wherein the seal interfaces with the inlet to open and close the inlet, and wherein the seal is interfaced by an opening and closing means that resides in the second region and does not extend into the first region.

10. The ink delivery system of claim 9 wherein the seal is activated by a cam or a lever, which is the opening and closing means, from the second region to move the seal off of the inlet and the valve in an open position where the portion of the supply of ink flows into the first region and out of the outlet.

11. The ink delivery system of claim 9 wherein the seal is closed by a force being applied to the opening and closing means which moves against a second region side of the Elastomer material to cause the seal to cover the inlet and decrease an area of the first region.

12. The ink delivery system of claim 11 wherein the force is applied by a spring that is released from a coiled position causing the seal to cover and press against the inlet.

13. The ink delivery system of claim 9 wherein the seal is activated to close and/or open the inlet by an external mechanism, the external mechanism interfaces through an opening in the second region and interfaces to the opening and closing means.

14. The ink delivery system of claim 13 wherein the opening provides minimal clearance space for the external mechanism to interface with the second region.

15. The ink delivery system of claim 14 wherein the opening includes a bushing or o-ring that surrounds a portion of the external mechanism interfacing with the opening and closing means within the second region.

16. An ink delivery system, comprising:

an encasing for housing a valve that moves a portion of a supply of ink provided to a printhead;

an actuation means that opens and closes a seal for an inlet of the encasing, the inlet provides the portion of the supply of ink from an ink source; and wherein the encasing includes an outlet for delivering the portion of the supply of ink to the printhead and a central cavity segmented into two regions, the first region houses the portion of the supply of ink when the actuation means opens the seal and the second region includes an interface to an actuation source that supplies a force to open the seal, and wherein the actuation means resides within the second region and does not extend into the first region.

17. The ink delivery system of claim 16 wherein the two regions are segmented with an Elastomer material.

18. The ink delivery system of claim 17 wherein the seal is a bump of the Elastomer material adapted to cover the inlet.

19. The ink delivery system of claim 16 wherein the interface enters the encasing through an opening and is surrounded by a bushing or o-ring.

20. The ink delivery system of claim 16 wherein the actuation means is a spring combined with a cam and/or lever.

21. The ink delivery system of claim 20 wherein the cam and/or lever exerts a force to compress the spring when the seal is open and releases the force when the seal is closed.

22. A method for moving ink through an ink delivery system, comprising:

receiving instruction from a printer controller to provide a portion of the supply of ink to a printhead of the ink delivery system;

moving a seal with an opening and closing means away from an inlet where the portion of the supply of ink is provided, and wherein the opening and closing means remains in a second region and does not extend into a first region having the portion of the supply of ink; and ejecting the portion of the supply of ink through an outlet to the printhead.

23. The method of claim 22 wherein in moving, the seal is a bump in an Elastomer material that separates an internal cavity into the first and second regions, the first region permits the portion of the ink supply to flow from the inlet to the outlet, and the second region includes a force means as part of the opening and closing means that moves the bump away from the inlet to start a flow of the portion of the supply of ink into the first region.

24. The method of claim 23 further comprising humidifying the second region.

25. The method of claim 22 further comprising, moving the seal to close the inlet via the opening and closing means preventing a flow of the portion of the supply of ink when an instruction is received from the printer controller to stop delivering the portion of the supply of ink to the printhead.

26. The method of claim 22 wherein in moving, an Elastomer material located in a central cavity separates the central cavity into the first region and the second region, the first region permits a flow of the portion of the supply of ink from the inlet to the outlet, and the second region includes a cam or lever interface which is the opening and closing means that moves the seal away from the inlet and against the inlet.

27. The method of claim 22 wherein in the seal is between 2 to 4 millimeters in diameter.

28. The method of claim 22 wherein the method is implemented as a valve within the ink delivery system.

* * * * *